US006135519A

United States Patent [19]

Kotlinski

[11] Patent Number: 6,135,519

[45] Date of Patent: Oct. 24, 2000

[54] DEVICE FOR COLLECTING WASTE SUCH AS ANIMAL DEJECTION

[76] Inventor: Michel Kotlinski, 1, place de l'Arbonnoise, 59000 Lille, France

[21] Appl. No.: 09/446,300

[22] PCT Filed: Jun. 26, 1998

[86] PCT No.: PCT/FR98/01362

§ 371 Date: Dec. 20, 1999

§ 102(e) Date: Dec. 20, 1999

[87] PCT Pub. No.: WO99/00551

PCT Pub. Date: Jan. 7, 1999

[30] Foreign Application Priority Data

Jun. 27, 1997 [FR] France ..... 97 08365

[51] Int. Cl.[7] ..... A01K 29/00; E01H 1/12

[52] U.S. Cl. ..... 294/1.3; 15/257.6

[58] Field of Search ..... 294/1.3, 1.4, 25, 294/55; 15/104.8, 257.1, 257.2, 257.6, 257.7, 257.9; 119/161; 220/345.1, 350, 351; 229/117.09, 103, 129, 129.1

[56] References Cited

U.S. PATENT DOCUMENTS

| | | | |
|---|---|---|---|
| 4,138,153 | 2/1979 | Brown | 294/1.3 X |
| 4,215,888 | 8/1980 | Gavin et al. | 294/1.3 |
| 4,529,236 | 7/1985 | Vogt | 294/1.3 |
| 4,830,419 | 5/1989 | Watanabe . | |
| 4,865,371 | 9/1989 | Egberg | 294/1.3 |

FOREIGN PATENT DOCUMENTS

| | | | |
|---|---|---|---|
| 0 176 814 A1 | 4/1986 | European Pat. Off. . | |
| 3404037 A1 | 8/1985 | Germany . | |
| 448823 | 6/1936 | United Kingdom | 294/1.3 |

*Primary Examiner*—Johnny D. Cherry

*Attorney, Agent, or Firm*—Miles & Stockbridge P.C.; Edward J. Kondracki

[57] ABSTRACT

The invention relates to a device for picking up an object from the ground comprising a set of rigid walls forming a box (2) with an opening for receiving the waste; a piece (4) for at least partially closing the opening. The invention is characterized in that the opening (3) extends in a substantially vertical plane at the front of the box (2); the closing piece (4) is borne by one of the ends (7, 8) of at least one thin element (9) guided in translation on the box in a direction substantially perpendicular to the opening plane of the box.

8 Claims, 3 Drawing Sheets

DEVICE FOR COLLECTING WASTE SUCH AS ANIMAL DEJECTION

Figure 1:
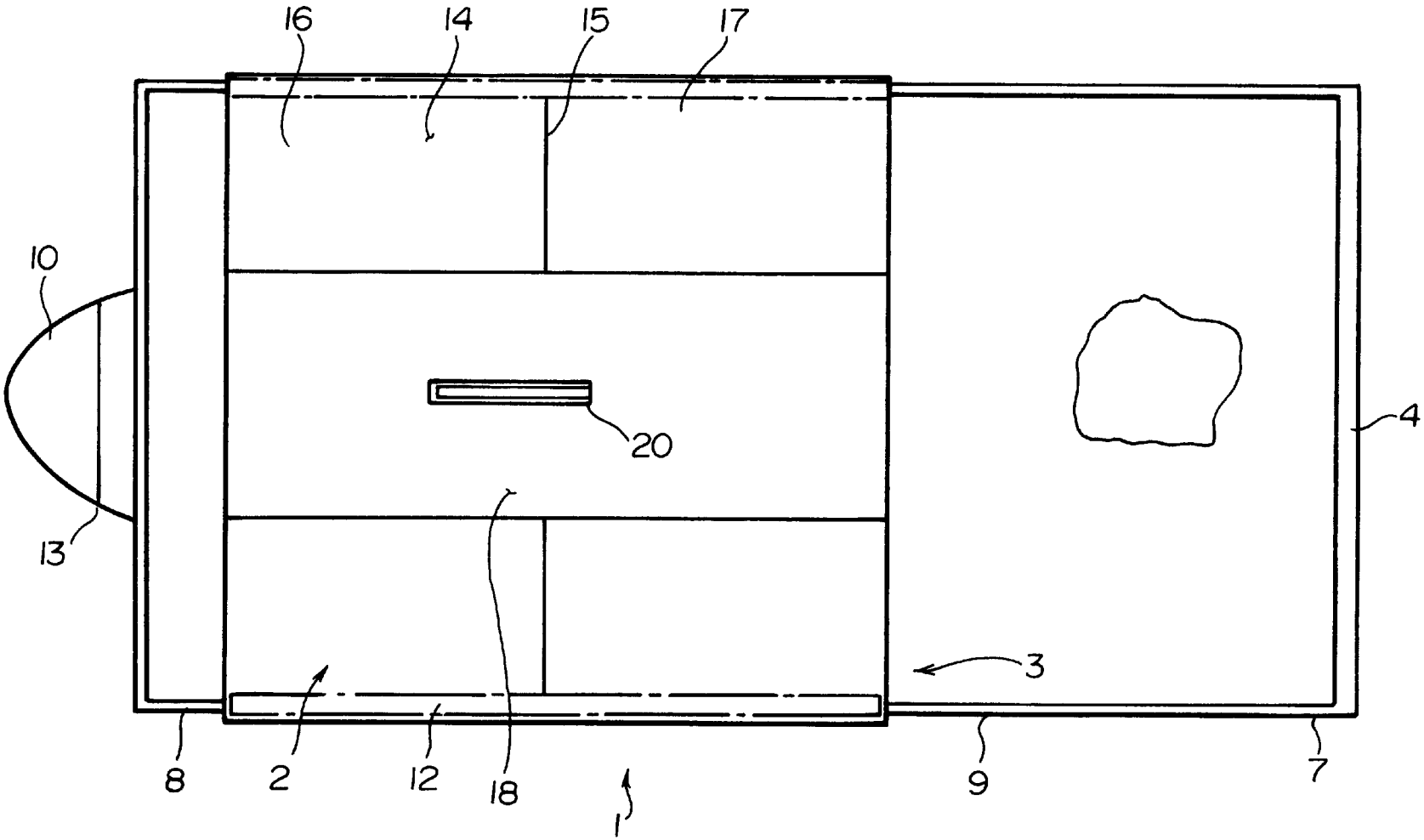

The invention relates to a device for collecting objects on the ground such as wastes or animal dejections.

The increase in the number of domestic animals such as dogs in cities has resulted in an increase in the pollution of our sidewalks.

To fight against this phenomenon, authorities have sometimes had to take corrective measures and make arrangements for cleaning, and thus certain cities are equipped with specialized vehicles.

Other cities provide animal owners with individual collection devices.

Thus, there are known devices existing in the form of a flexible, or at least locally flexible, bag.

When the user collects the waste, the smell is unpleasant, and this acts as a deterrent to the utilization of these devices.

There are known rigid-walled devices comprising:

a set of rigid walls forming a box having an opening for the insertion of the waste, a piece for at least partially closing the above-mentioned opening, a means for grasping the device.

Thus, for example, it may be a box with a sliding bottom (FR-A-2647825, FR-A-2652101) which is first manipulated so as to uncover the opening.

The box is then placed over the waste and the bottom is returned to its initial position so as to close the box, which then contains the waste.

When maneuvering the bottom of the box, the operator risks soiling his hands.

Instead of the bottom, it could be a frontal wall (DE-A-3.404.037).

Unfortunately, this box is not collapsible, and is therefore quite bulky.

There is also a known device (WO-A-8905886) comprising two half-boxes articulated to each other, either around a common fold so as to form a sort of grip, or on a slide (U.S. Pat. No. 4,830,419).

With this device, it is difficult to keep the grip closed after use.

One of the intended results of the invention is a collection device of the above-mentioned type comprising:

a set of rigid walls forming a box having an opening for the insertion of the waste, a piece for at least partially closing the above-mentioned opening, and a means for grasping the device with the opening, which extends in an approximately vertical plane at the front of the box, the closing piece, which is borne by one of the ends of at least one thin element guided in translation on the box in a direction approximately perpendicular to the plane of the opening of the box, the other end of the thin element having, at least indirectly, a handling means that makes it possible to move the closing piece toward the opening, this device being characterized in that:

it comprises two thin elements which, with the closing piece and at least indirectly the handling means, form a frame, and these two thin elements, existing in the form of strips sliding in grooves provided in the two lateral walls of the box, which are orthogonal to the opening, and the thin elements comprise means that make it possible to fold them locally in order to reduce their length and consequently the bulkiness of the device.

Figure 2:
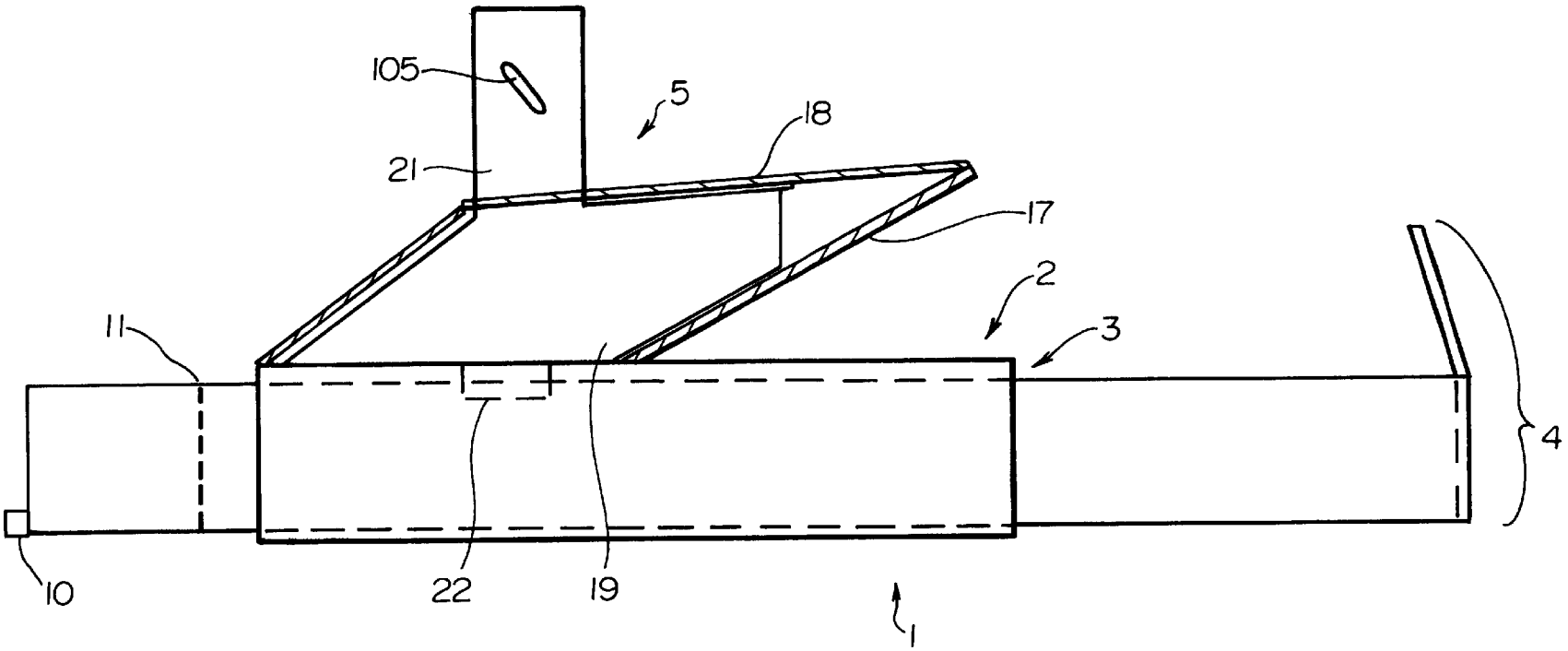
Figure 3:
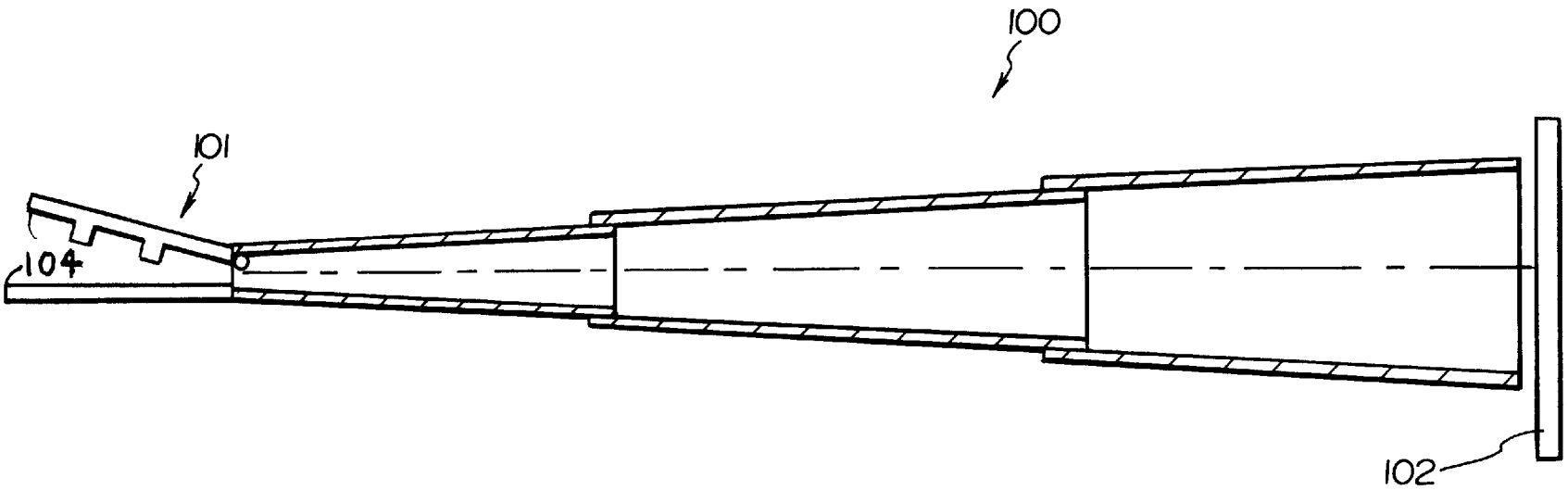

The invention will be clearly understood with the aid of the following description given as a non-limiting example, in reference to the attached drawing, which schematically represents;

FIG. 1: top view of a device,

FIG. 2: side view of the device,

FIG. 3: an accessory.

By referring to the drawing, it may be seen that the device 1 for collecting wastes such as animal dejections comprises:

a set of rigid walls forming a box 2 having an opening 3 for the insertion of the waste, a piece 4 for at least partially closing the abovementioned opening and a means 5 for grasping the device.

According to one characteristic of the invention:

the opening 3 extends in an approximately vertical plane at the front of the box 2, the closing piece 4 is borne by one 7 of the ends 7, 8 of at least one thin element 9 guided in translation on the box in a direction approximately perpendicular to the plane of the opening of the box, and the other end 8 of the thin element has, at least indirectly, a handling means 10 that makes it possible to move the closing piece 4 toward the opening 3 and the thin element 9 comprises means 11 that make it possible to fold it locally in order to reduce its length, and consequently the bulkiness of the device.

The device comprises two thin elements 9 which, with the closing piece 4 and at least indirectly the handling means, form a frame, and these two thin elements 9, existing in the form of strips, slide in grooves 12 provided in the two lateral walls of the box, which are orthogonal to the opening.

The handling means 10 extends approximately in the plane of the horizontal bottom of the box toward the rear, and has at least one fold line 13 for folding it at least partially back onto the box.

The size of this handling means is sufficient for placing the bottom of the foot on it and immobilizing the frame for the time required to maneuver the box and push it toward the closing piece, possibly with an accessory 100 such as a handle, particularly telescopic.

The top wall 14 of the box has a fold line 15 parallel to the front surface of the box, which delimits a rear wall portion 16 which, during the assembly of the box, is immobilized relative to the other walls, and a wall portion 17 near the front forming a flap 17 that is movable between a first position in which this flap is in a plane parallel to the bottom of the box and a second position in which the free edge of this flap is raised to enlarge the opening 3 of the device, and thus facilitate the introduction of the waste.

In order to raise this flap and hold it in its raised position, the device comprises:

a pull 18, one end of which is attached to the free end of the flap, and the other end of which is attached to the rear of the box, and resting on the top of the box and on the pull, a rigid finger 19 that tilts in order to separate the pull from the top of the box.

The pull is a strip of material, for example made of cardboard like the rest of the box, having a cutout 20 through which projects a part 21 of the rigid finger, this part constituting the means 5 for grasping the device.

The top of the box has a notch 22 in which the bottom of the rigid finger is positioned when the flap has been raised enough, so that when the finger is immobilized, the flap is too.

The projecting part of the finger can be grasped by a set of pincers 101 supported by the end of a telescopic handle 100 housing a handling means 102 that makes it possible to control at least the opening of the pincers, its closing being obtained by a return spring.

The jaws of the pincers can comprise tips 104 that fit into a cutout 105 of the projecting part of the finger.

In order to use it, the user grasps the closing piece and separates it from the opening, which causes the deployment of the thin elements.

By tilting the rigid finger, he raises the flap.

He can then gather the wastes with the aid of the closing piece, which serves as a scraper.

This closing piece could have a toothed lower edge, and its upper part could be extended above the plane that contains the top surface of the box.

He then positions the device so that the waste is contained between the opening, the two thin elements and the closing piece, and through the relative displacement of the box and the closing piece, the waste is inserted into the box, which can then be thrown into a trash can.

Advantageously, it is the box that is pushed toward the closing piece, while placing the foot on the handling means 10.

The advantage of this movement is that it avoids soiling the ground as if the movement were reversed.

Handicapped people could use this device to pick up an object dropped on the ground by making use of the handle.

Another advantage is that it is quite suitable for collecting syringes on the ground.

Municipal personnel can travel with several boxes in their pockets in folded form and hence not very bulky, in order to be able to act quickly.

What is claimed is:

1. Device for collecting an object on the ground, comprising:

a set of rigid walls forming a box (2) having an opening (3) for the insertion of the object, a piece (4) for at least partially closing the above-mentioned opening and a means (5) for grasping the device with, the opening (3) which extends in an approximately vertical plane at the front of the box, the closing piece (4), which is borne by one (7) of the ends (7, 8) of at least one thin element (9) guided in translation on the box in a direction approximately perpendicular to the plane of the opening of the box, the other end (8) of the thin element having, at least indirectly, a handling means (10) that makes it possible to move the closing piece (4) toward the opening (3), this device being characterized in that:

it comprises two thin elements (9) which, with the closing piece (4) and at least indirectly the handling means, form a frame, these two thin elements (9), existing in the form of strips, sliding in grooves (12) provided in the two lateral walls of the box, which are orthogonal to the opening, and the thin elements (9) comprise means (11) that make it possible to fold them locally in order to reduce their length, and consequently the bulkiness of the device.

2. Device for collecting wastes according to claim 1, characterized in that the handling means (10) extends approximately in the plane of the horizontal bottom of the box toward the rear, and has at least one fold line (13) for folding it back at least partially.

3. Device for collecting wastes according to claim 1, characterized in that the top wall (14) of the box has a fold line (15) parallel to the front surface of the box, delimiting a rear wall portion (16) which, during the assembly of the box, is immobilized relative to the other walls, and a wall portion (17) near the front forming a flap (17) that is movable between a first position in which this flap is in a plane parallel to the bottom of the box and a second position in which the free edge of this flap is raised to enlarge the opening (3) of the device and facilitate the introduction of the waste.

4. Device for collecting wastes according to claim 3, characterized in that, in order to raise the flap and hold it in its raised position, the device comprises:

a pull (18), one end of which is attached to the free end of the flap and the other end of which is attached to the rear of the box, and resting on the top of the box and on the pull, a rigid finger (19) that tilts in order to separate the pull from the top of the box.

5. Device for collecting wastes according to claim 4, characterized in that the pull is a strip made of cardboard like the rest of the box, having a cutout (20) through which projects a part (21) of the rigid finger, this part (21) constituting the means (5) for grasping the device.

6. Device for collecting wastes according to claim 5, characterized in that the top of the box has a notch (22) in which the bottom of the rigid finger is positioned when the flap has been raised enough, so that when the finger is immobilized, the flap is too.

7. Device for collecting wastes according to claim 1, characterized in that it comprises a telescopic handle comprising a set of pincers grasping the handling means (5).

8. Device for collecting wastes according to claim 7, characterized in that the jaws of the claw comprise tips that fit into a cutout presented by the projecting part of the rigid finger.

* * * * *